US005131306A

United States Patent [19]

Yamamoto

[11] Patent Number: 5,131,306

[45] Date of Patent: Jul. 21, 1992

[54] AUTOMATIC MUSIC PLAYING PIANO

[75] Inventor: Jun Yamamoto, Hamamatsu, Japan

[73] Assignee: Yamaha Corporation, Hamamatsu, Japan

[21] Appl. No.: 467,268

[22] Filed: Jan. 18, 1990

[30] Foreign Application Priority Data

Jan. 19, 1989 [JP] Japan ..... 1-10176

[51] Int. Cl.[5] ..... G10F 1/02

[52] U.S. Cl. ..... 84/19; 84/462

[58] Field of Search ..... 84/626, 627, 633, 13, 84/462, 463, 19

[56] References Cited

U.S. PATENT DOCUMENTS 4,450,749 5/1984 Stahnke ..... 84/462

*Primary Examiner*—L. T. Hix
*Assistant Examiner*—Eddie C. Lee
*Attorney, Agent, or Firm*—Spensley Horn Jubas & Lubitz

[57] ABSTRACT

The present invention relates to a pedal movement control and recording apparatus for an automatic music playing piano in which the pedal displacement corresponding to sequentially changing pedal control signals is determined in order to generate a pedal position conversion table, and which provides means for generating position data normalization tables and reverse normalization tables, whereby music performed on one piano can be replayed on a second automatic music playing piano, correcting for the unique response characteristics of each piano, thereby preserving nuances of pedal movement during replay.

24 Claims, 12 Drawing Sheets

AUTOMATIC MUSIC PLAYING PIANO

FIELD OF THE INVENTION

The present invention relates to automatic music playing pianos and in particular relates to a pedal movement control apparatus for automatic music playing pianos.

BACKGROUND ART

For automatic music playing pianos, in general, performance data which has been recorded on a floppy disk or similar type of data recording media is read out from the media, and according to the data thus read out, key solenoids and pedal solenoids are activated. In the case of automatic playing pedal mechanisms in which the pedals alternate between a fully depressed state and a fully released state, a pedal solenoid which can be controlled between an on state and an off state is ordinarily sufficient. Thus, for recording performance data for this type of 2 mode automatic pedal mechanism, it suffices to detect only the fully depressed and fully released pedal states for the respective pedal. Similarly, during play back of the recorded data, it is sufficient for the pedal to merely switch between on and off states based on the recorded performance data.

In order to improve the music reproduction characteristics, it is necessary to be able to reproduce half pedal states as well as the fully released and fully depressed states. In order to prepare performance data which permits the replaying of half pedal states, it is necessary to continuously detect pedal position during the recording of a performance. By so doing, during automatic playing of a previously recorded performance, the respective pedal reacts only to the extent indicated by the recorded performance data.

With the type of prior art automatic playing pedal mechanism described above, feed back control of the electrical power supplied to the solenoids may be carried out. In the case of such feed back control, pulse width modulation (PWM) is often employed for the solenoid control signals. Additionally, simple control of the voltage and/or current of the control signals is sometimes employed.

In regard to the object of control itself, the piano pedal mechanisms, it is well known that the response characteristics and other mechanical characteristics of the respective pedal mechanisms vary widely from piano to piano. Additionally, each piano has several different types of pedals (for example the loud pedal and the shift pedal), each with different response characteristics and requirements as well. Furthermore, it is difficult to manufacture solenoids with uniform response characteristics. Additionally, the amount of displacement of solenoid plungers does not have a linear relationship with the supplied electrical power.

Because of the above described properties, when a musical performance is recorded on one conventional automatic music playing piano and replayed on another using the recorded performance data, faithful reproduction of the pedal effects of the original piano, and therefore faithful reproduction of the original piano performance cannot be achieved.

SUMMARY OF THE INVENTION

In light of the above described problems, it is an object of the present invention to provide a pedal movement control and recording apparatus for an automatic music playing piano in which the relationship between pedal movements and the corresponding signals delivered to the respective pedal solenoids can be automatically determined, by which means the pedal effects of the original performance are faithfully reproduced on a piano other than the piano on which the music was originally performed, and accordingly, by which means the nuances of the original performance are faithfully reproduced on a second instrument.

In order to achieve the above object, one aspect of the present invention provides a piano as shown in FIG. 1, which includes a pedal P for control of the tone of music played on the keyboard of the instrument. Additionally, the piano includes a pedal drive means 1 for driving the above mentioned pedal P, a pedal displacement detection means 2 for measuring displacement of the pedal P, and a conversion table creation means 3 for creation of conversion tables by sequentially varying the signal supplied to the above mentioned pedal drive means 1, and based on the relationship between the pedal displacement detected by the above mention pedal displacement detection means 2 and the signal supplied to the above mentioned pedal drive means 1, creating a table correlating the value of the signal supplied to the pedal drive means 1 and the amount of pedal displacement.

With the automatic music playing piano of the present invention, the conversion table creation means 3 supplies a drive signal to the pedal drive means 1, whereby the pedal drive means causes the pedal P to displace a corresponding distance. As the pedal P moves, the pedal displacement detection means detects the amount of displacement, the result of which is output from the pedal displacement detection means 2. The above described result output from the pedal displacement detection means 2 is dependent on the response characteristics and other mechanical characteristics peculiar to the pedal mechanism of the piano which is being operated. Accordingly, based on the relationship between the amount of pedal displacement detected by the above mention pedal displacement detection means 2 and the signal supplied to the above mentioned pedal drive means 1, a table correlating the value of the signal supplied to the pedal drive means 1 and the amount of pedal displacement is created which reflects the response characteristics and other mechanical characteristics of the pedal mechanism of the piano for which the conversion table is being generated.

Another aspect of the present invention provides a piano as shown in FIG. 2, which includes a pedal P for control of the tone of music played on the keyboard of the instrument. Additionally, the piano includes a pedal drive means 1 for driving the above mentioned pedal P, a pedal displacement detection means 2 for measuring displacement of the pedal P, and a state judgment means 4 for judging the state of the pedal, based on the relationship between the pedal displacement detected by the above mention pedal displacement detection means 2 and the signal supplied to the above mentioned pedal drive means 1 while sequentially varying the signal supplied to the pedal drive means 1.

With the automatic music playing piano of the present invention, the above mentioned state judgment means 4 supplies a drive signal to the pedal drive means 1, whereby based on the relation of the result output from the pedal displacement detection means 2 and the drive signal supplied to the pedal drive means 1, the state of the pedal is determined. This it is possible to determine position information for the various pedal states such as the half pedal state, or the slack state (state during which initial movement of the pedal has no effect on the tone due to mechanical free play in the pedal mechanism), by which means the response characteristics and other mechanical characteristics of the pedal mechanism of the operated piano are more accurately captured and reproduced during replay.

DETAILED DESCRIPTION OF THE PREFERRED EMBODIMENTS OF THE PRESENT INVENTION

A first preferred embodiment of the present invention will be described in the following section with reference to FIGS. 3–8.

Figure 1:
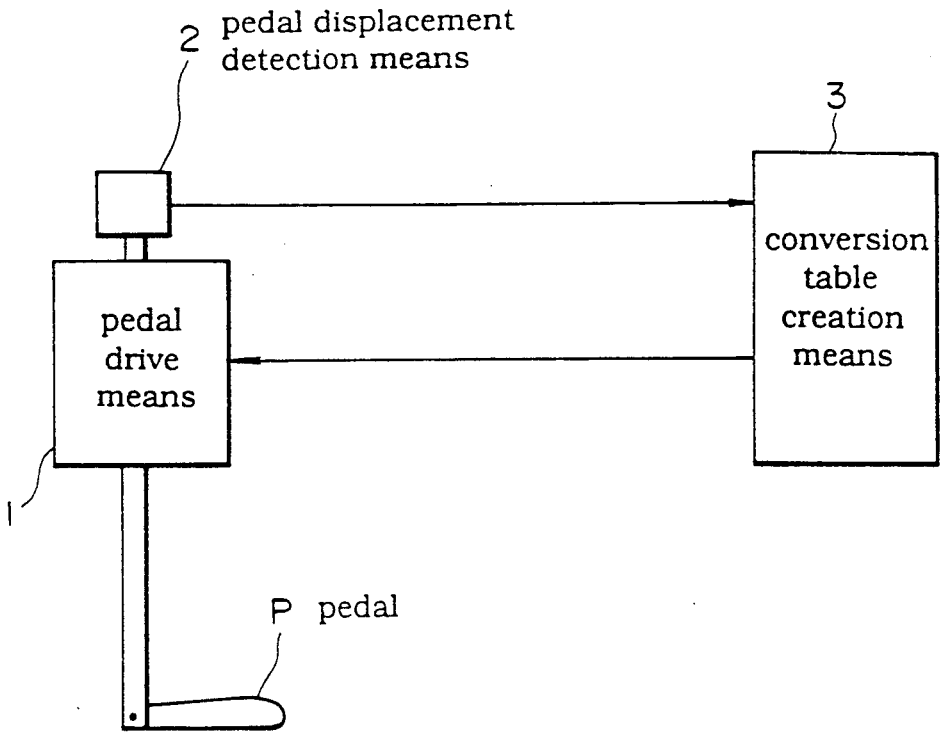
FIGS. 1 and 2 are block diagrams schematically representing the fundamental operations of the automatic music playing piano of the present invention.
Figure 2:
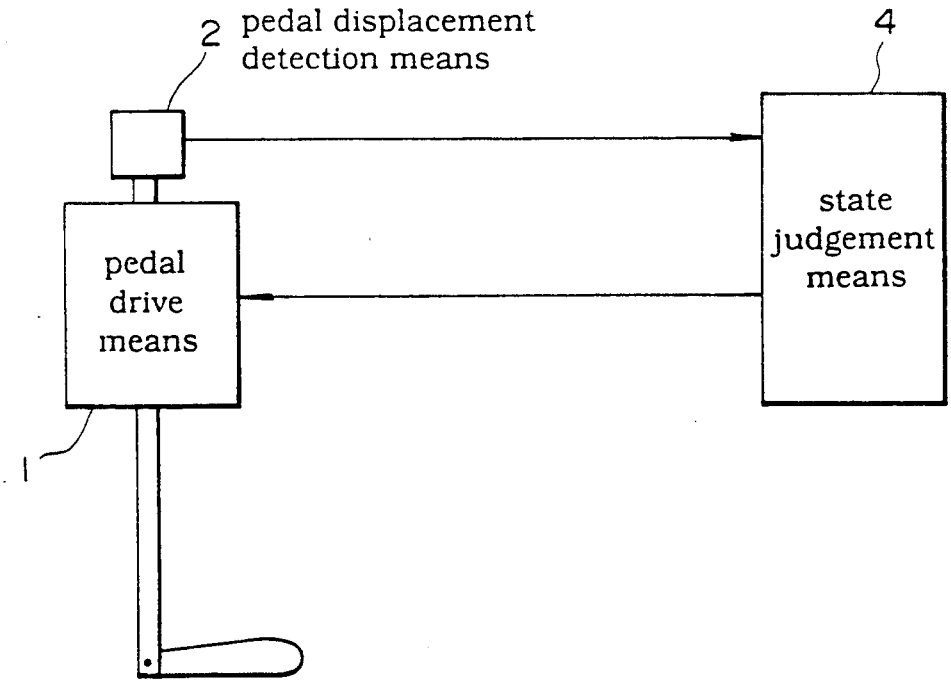
Figure 3:
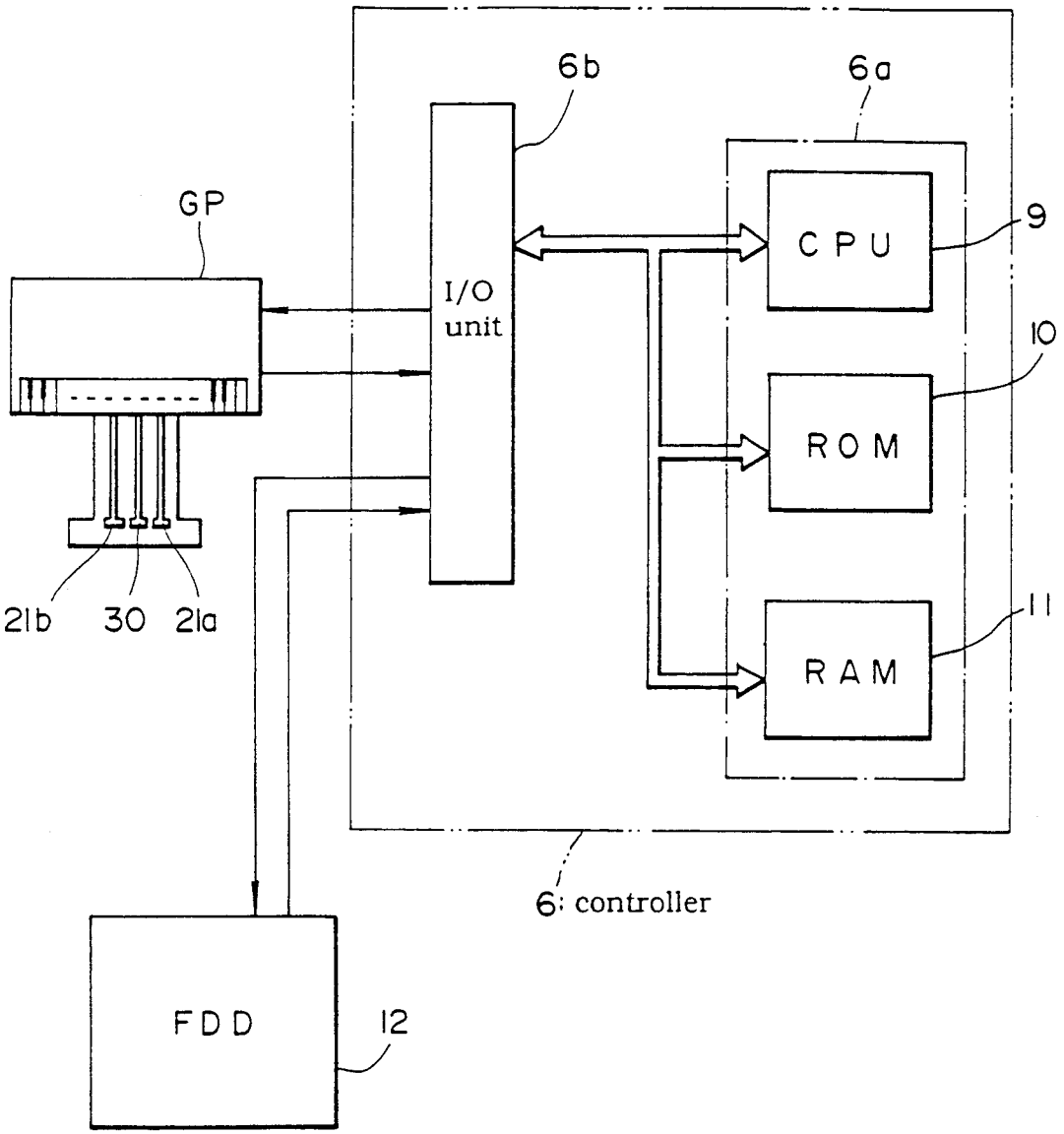
FIG. 3 is a block diagrams schematically representing the overall layout of the automatic music playing piano of a first preferred embodiment of the present invention.

FIG. 3 is a block diagram of this first preferred embodiment of the present invention. In FIG. 3, GP indicates a piano which carries out automatic music performance controlled by and in response to performance data delivered from controller 6. Furthermore, when the piano GP is played by a human performer, based on the human performance, control data is supplied from the piano to the controller 6.

Figure 4:
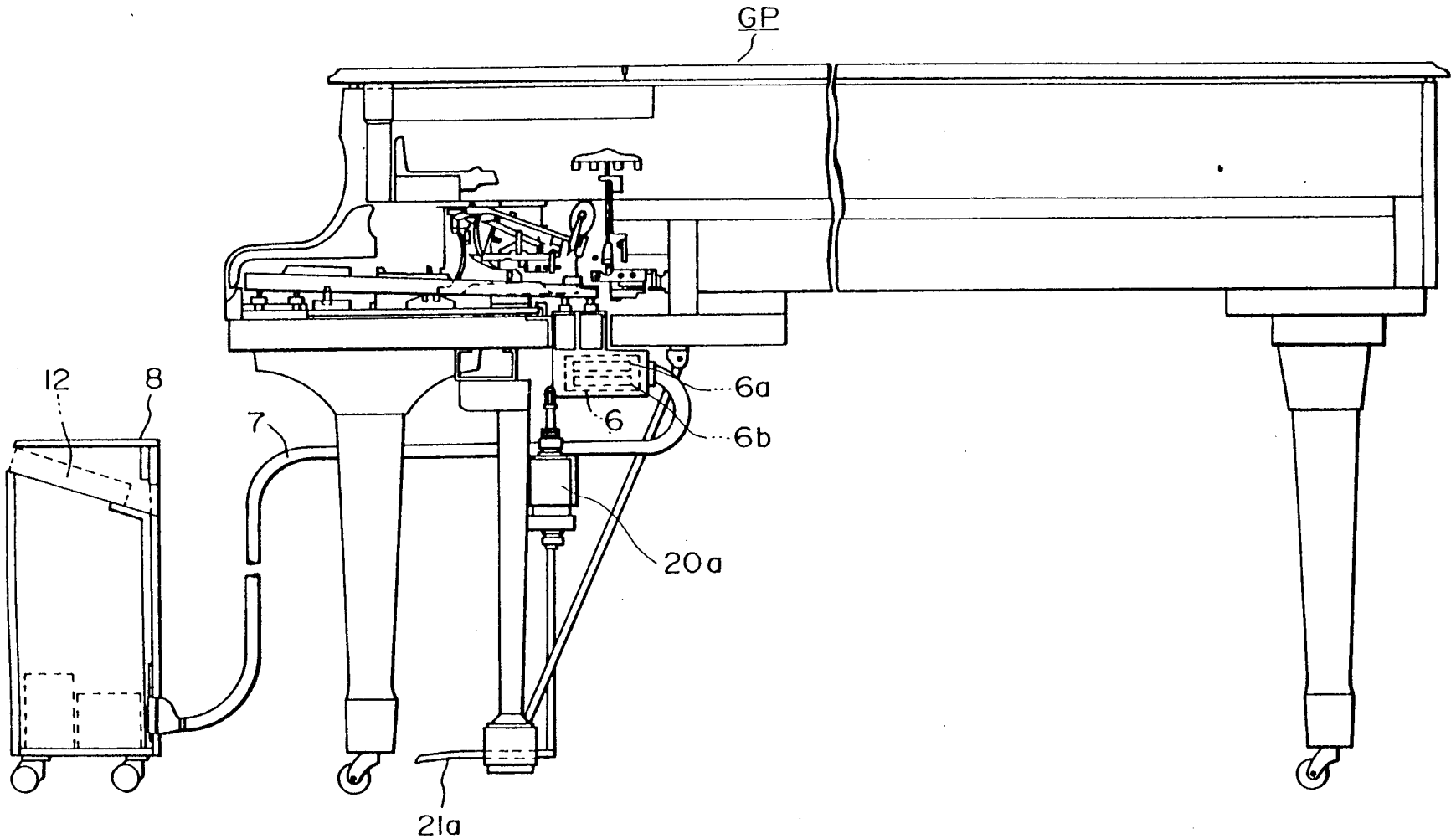
FIG. 4 is an exposed side view of the piano of the first preferred embodiment of the present invention.

FIG. 4 is a side view of piano GP which also shows the external appearance of a peripheral device. As shown in the drawing, the controller 6 is mounted on the underside of the piano. As shown in FIG. 4, a cable 7 intervenes between the controller 6 and the peripheral equipment which is provided on a cart 8, through which means the various types of control data are transmitted between the controller 6 and the peripheral equipment. The controller 6 is provided within a key drive unit which is provided as part of the piano component of the automatic music playing piano.

The controller 6 is further partitioned into a control unit 6*a* and a I/O unit 6*b*. The control unit 6*a* is made up of a CPU (central processing unit) 9 which controls each part of the automatic music playing piano, ROM (read only memory) 10 which contains a program for use by CPU 9, and RAM (random access memory) 10 wherein various types of data as well as a position table to be described below are temporarily stored. Controller 6*a* is connected with the automatic music playing piano GP as well as floppy disk drive (hereafter referred to as FFD) 12 via I/O unit 6*b* and carries out the recording as well as read-out of performance data.

Figure 5:
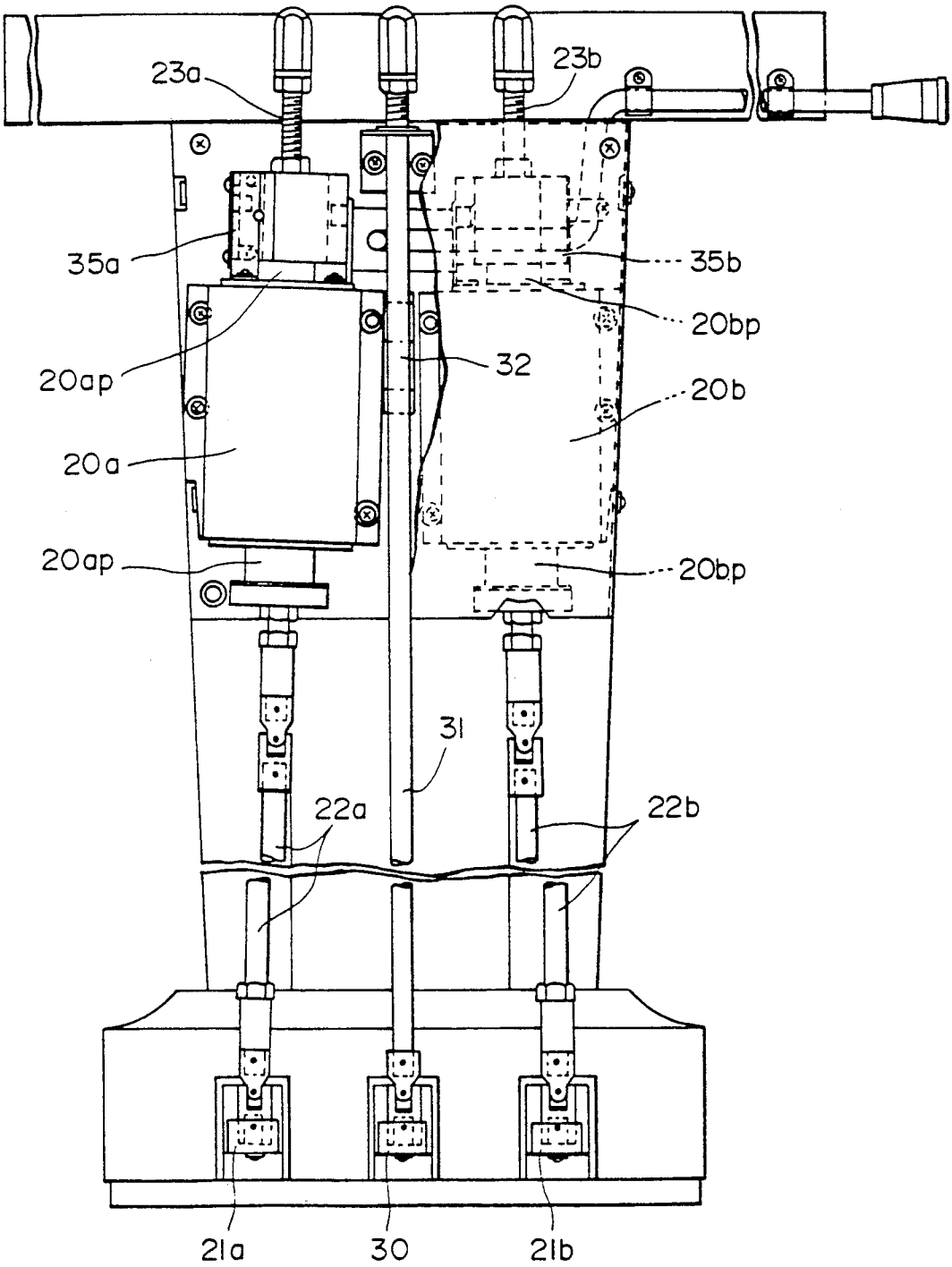
FIG. 5 is an exposed front view showing the pedal drive mechanisms and their relationship with the pedal drive solenoids.

The solenoid 20*a* shown in FIG. 5 from the rear drives loud pedal 21*a*. As shown in FIG. 5, the end of loud pedal 21*a* is connected to the lower end of rod 22*a* which moves up and down freely, the connection being freely pivotable. The upper end of rod 22*a* is in turn connected with the lower end of plunger 20*ap* of solenoid 20*a*, again so as to be freely pivotable. The upper end of plunger 20*ap* is connected with rod 23*a* which is in turn connected with the damper drive mechanism within the piano. Solenoid 20*b* drives shift pedal 21*b* and in a fashion identical to that of the loud pedal 21*a* side, is connected to rods 22*a* and 23*a*, thereby transmitting various driving forces to shift pedal 21*b*.

At the upper end of both solenoid 20*a* and 20*b*, sensors 35*a* and 35*b* are respectively provided by which means the positions and movement of the loud pedal and the shift pedal are detected. Each sensor, sensor 35*a* and 35*b* is made up of a grey scale (continuously varying optical density component) which moves in concert with its respective plunger 20*ap* or 20*bp*, a light source which illuminates the moving grey scale from the side at a fixed position, and a light intensity detector which measures the intensity of the light transmitted through the moving grey scale at a fixed position. The above mentioned light source may be, for example, an LED (light emitting diode), solid state laser, or a conventional incandescent, fluorescent, or gas (e.g. neon) illumination producing element. Similarly, the light intensity detector may be a photo-resistor, photo-transistor, or similar light intensity measuring means. By means of the output signals from the respective light intensity detectors of sensors 35*a* and 35*b*, the position and movement of loud pedal 21*a* and shift pedal 21*b* are determined.

Sustaining pedal 30 is provided between loud pedal 21*a* and shift pedal 21*b* and is connected to the lower end of unitary rod 31 so as to be freely movable in an up and down direction. Sensor 32 is connected to the upper end of rod 31, and has a function analogous to that of sensors 20*a* and 20*b*. In the case of the sustaining pedal, however, no solenoid is employed.

In the following section, the operation of the first preferred embodiment of the present invention will be described. In particular, the drawing up of a data conversion table and output of control signals will be described along with data recording and read-out operations.

Figure 6:
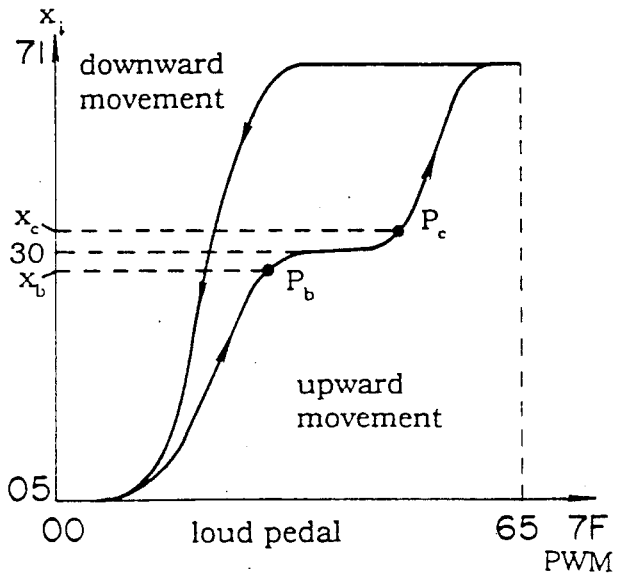
FIG. 6 is a pedal characteristics chart for the loud pedal showing the relationship between the drive signal and pedal displacement for the automatic music playing piano of the first preferred embodiment of the present invention.

First of all, the principles of pedal position and movement measurement will be described. A PWM (pulse width modulated) signal is applied to solenoid 20*a*. As the width of the pulses in the signal are successively increased, the connection of loud pedal 21*a* and rod 22*a* is drawn upward to its highest position through the action of the solenoid. After this point, the widths of the pulses are successively decreased and the connection of loud pedal 21*a* and rod 22*a* reaches its lowermost position. The above described motion of the loud pedal and its relationship to pulse width in the PWM signal is shown in FIG. 6. In FIG. 6, the abscissa is inscribed with control codes ranging from 00 to 7F hexadecimal which indicate greater width of the PWM signal pulses as well as increasing displacement upward of the end of the loud pedal joined with rod 22*a*. The above mentioned control codes are not limited to 00–7F hexadecimal, but rather, the range may be freely chosen as dictated by design considerations and preference. The ordinate in FIG. 6 indicates loud pedal displacement. This displacement of the loud pedal is converted into position signal values x of 128 levels (0–7F HEX) by an A/D converter from the signal output from detector 35*a*.

The characteristics of the relation between displacement of the loud pedal and the PWM signal pulse width shown in FIG. 6 are governed by the elastic characteristics of the components of the pedal drive mechanism assembly as well as play or mechanical slackness between the individual components. In the graph of the curve for the rising pedal, the initial portion is called the slack region and represents the period when play or mechanical slackness between the components of the drive mechanism occur. The curve for the rising pedal has an intermediate plateau portion following the slack region which is the half pedal region and will be described further below.

Figure 7:
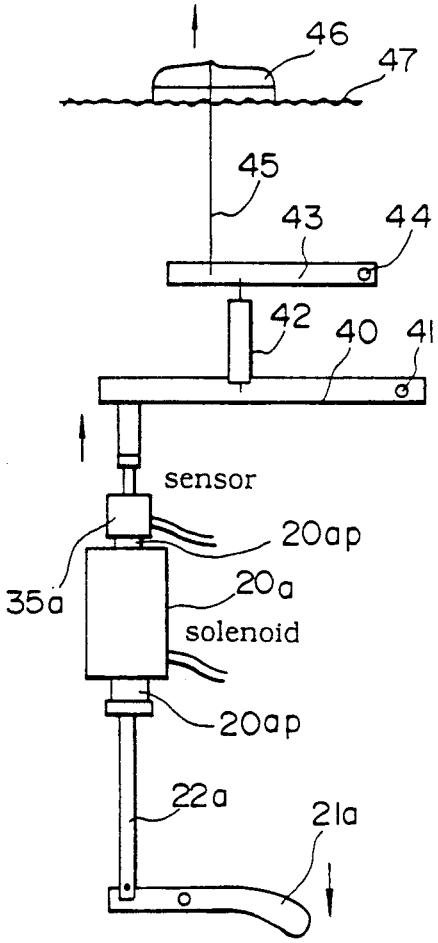
FIG. 7 is a schematic side of the loud pedal and associated damper mechanism for the automatic music playing piano of the first preferred embodiment of the present invention.
Figure 8:
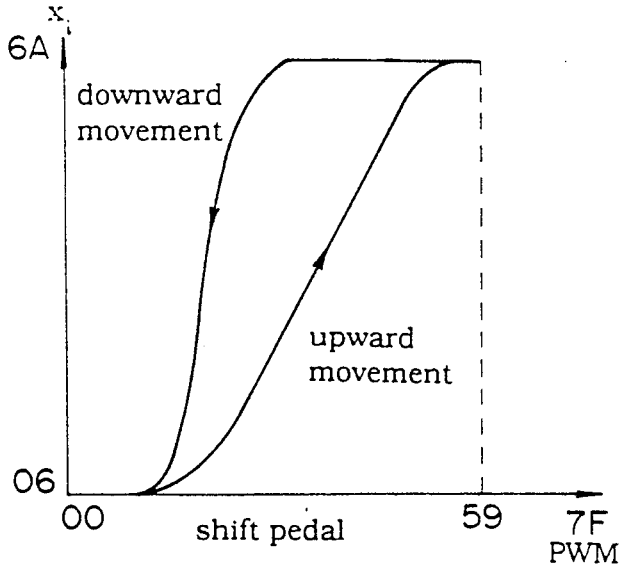
FIG. 8 is a pedal characteristics chart for the shift pedal showing the relationship between the drive signal and pedal displacement for the automatic music playing piano of the first preferred embodiment of the present invention.

FIG. 7 is a schematic side view of the loud pedal drive system. In the drawing, in response to the PWM signal, current flows in the coil of solenoid 20*a*, and according to the value of the signal, the plunger 20*ap* moves upward a corresponding displacement, being drawn into the solenoid. As the plunger 20*ap* moves upward, lever 40 rotates about pivot point 41, and rod 42 is thereby pushed upward. As rod 42 pushes upward, lever 43 is caused to pivot about pivot point 44 and damper 45 is thereby pushed upward. As damper 45 is pushed upward, the damper head 46 provided on its upper end separates from string 47. The range of movement in which the damper head 46 is completely separated from the string 47 is called the damper off region.

The range of movement from when driving force is first transmitted to damper head 46 until it is completely separated from the string 47 is the half pedal region mentioned above. In the half pedal region, even if the value of the PWM signal delivered to the solenoid 20*a* is increased, the upward motion of plunger 20*ap* is relatively small, as shown by the plateau region seen in FIG. 6.

As shown by the initial plateau region in the graph in FIG. 6 for downward motion of the solenoid, as the value of the PWM signal is lowered from its maximum value, the downward movement of the plunger 20*ap* and the associated drive mechanism from its maximum height is very small initially. After the above described initial plateau region for downward movement, the solenoid and connected drive mechanism and pedal move downward smoothly at a higher rate until the pedal reaches its original position.

In the present preferred embodiment of the present invention, CPU 9 causes the value of the PWM signal to increase in single increments, while at the same time, the displacement of plunger 20*ap* is determined based on the output of sensor 35*a*. Furthermore, pedal displacement positions $x_b$ and $x_c$ are determined, corresponding to point $P_b$ where the rate of change of plunger elevation decreases below a predetermined value and point $P_c$ where the rate of change of plunger elevation increases above a predetermined value, respectively (refer to FIG. 6). By means of the above described process, a slack region, half pedal region, and damper off region are determined and the process is thereby completed. The above mentioned slack region is defined as the interval from the onset of plunger elevation up to point $P_b$. The half pedal region is defined as the interval between point $P_b$ and point $P_c$. The damper off region is defined as the interval from point $P_c$ up to the position of maximum plunger displacement.

For the shift pedal 21*b*, the principles for measurement of movement and determination of specific positions is entirely analogous to that described for the loud pedal above. However in the case of the shift pedal 21*b*, as shown in the upward movement portion of the graph in FIG. 8, the upward displacement shows nearly linear characteristics. Accordingly, no half pedal region is determined as is for the loud pedal 21*a*.

In the following section, the data conversion tables will be described. In the present preferred embodiment of the present invention, there are three different types of data conversion tables which will be described below.

The first type of data conversion table to be described is a position - PWM signal conversion table in which, based upon the results of the above described measurements, position data $x_i$ are converted to PWM signal control codes. This position - PWM signal conversion table is used to convert position data read out from the floppy disk at the time of automatic performance to PWM signal control codes. By using this position - PWM signal conversion table, when performance data recorded on one piano is replayed on a different piano, compensation for differences in the response characteristics of the pedal mechanisms between the two instruments can be carried out. Furthermore, by regenerating the position - PWM signal conversion table at suitable interval, time change of the response characteristics of the pedal mechanisms can be compensated for as necessary over the years. When the position - PWM signal conversion table is drawn up as described above, data values in the table are corrected as necessary to correct for non-linear characteristics of the solenoid.

In the second type of data conversion table to be described, the 128 level position data table is converted to one having 16 levels. When the table is so converted, the data is normalized to correct for characteristics of the pedal mechanism.

Figure 9:
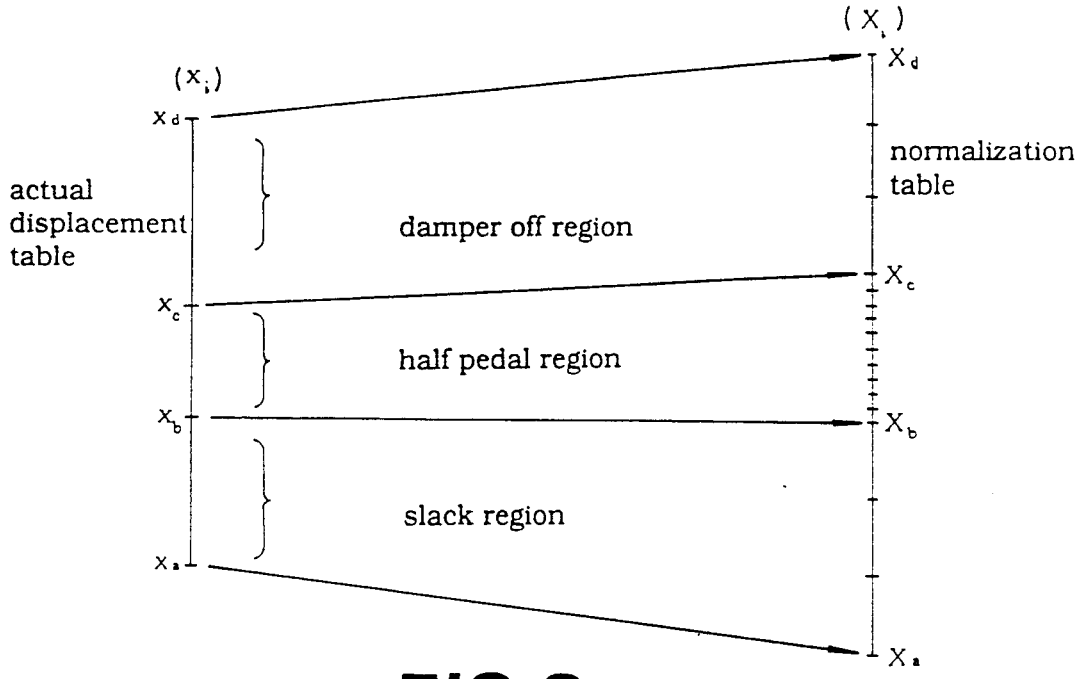
FIG. 9 is a graph showing the relationship between actual position data $x_i$ and normalized position data $X_i$ for the loud pedal for the automatic music playing piano of the first preferred embodiment of the present invention.

For example, as shown in FIG. 9 for the loud pedal 21*a* where values in the 128 levels position data table are represented by $x_i$, the previously determined values for the slack region, half pedal region and damper off region are normalized for the characteristics of the instrument, and furthermore, the data is compressed and allotted to 16 levels, represented by $X_i$ in the diagram. In FIG. 9 $x_a$, and accordingly $X_a$, represent the state in which no pressure is applied to the pedal, $x_b$ and $X_b$ represent the onset of the half pedal state, $x_c$ and $X_c$ represent the onset of the damper off state, and $x_d$ and $X_d$ represents the condition when the foot pressure of the player depresses the pedal to its lowest position. For the normalized values $X_i$, the half pedal region is allotted more values, and hence more finely subdivided than the slack region or the damper off region. This is because, in order to reproduce the fine nuances in a piano performance, it is necessary to accurately control the position of the loud pedal in the half pedal region. In the slack region or the damper off region there is no need for this type of fine control.

Figure 10:
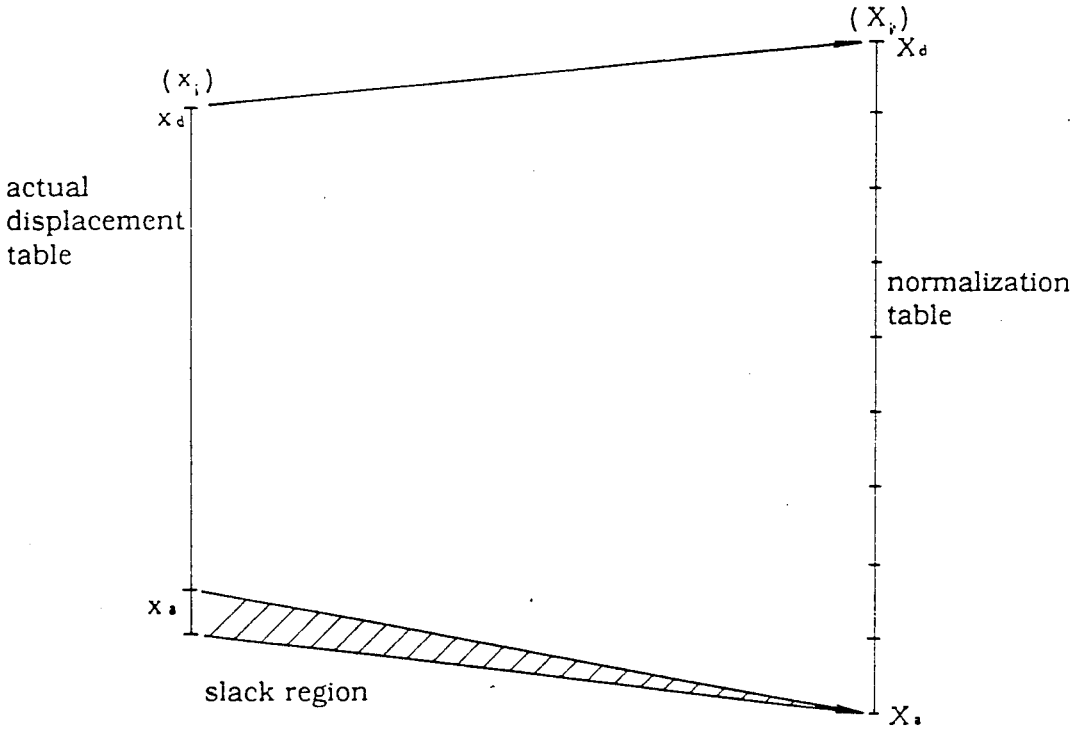
FIG. 10 is a graph showing the relationship between actual position data $x_i$ and normalized position data $X_i$ for the shift pedal for the automatic music playing piano of the first preferred embodiment of the present invention.

For the shift pedal 21*b*, as shown in FIG. 10, the normalized table is linearly allotted to 16 levels. This is due to the fact, as previously mentioned, that in the case of the shift pedal 21*b*, the upward displacement of the pedal shows nearly linear characteristics, as is seen in the graph in FIG. 8. In FIG. 10, the normalized values are represented by $X_i$ as with the loud pedal 21*a* as shown in FIG. 9. It can be seen that with the shift pedal 21*b*, all of the values $x_i$ corresponding to the slack region correlate with one $X_i$ value, $X_a$.

The reason why the normalized position data is compressed into 16 levels will be described in the following.

First of all, when an attempt is made to record the position data in 128 levels for a song on a disk that would ordinarily allow 70 minutes of recording time, the position data corresponding to no more than 15 minutes of playing time can be recorded on the same disk. For this reason, the position data is compressed to 16 levels. However, if the position data is merely compressed to 16 levels and recorded, when played on different pianos, due to the fact that the characteristics of the pedal mechanisms vary from piano to piano, the play-back of the pedal operation is likely to result in a negative effect on the quality of the replayed music. For this reason, for each piano, the position data $x_i$ is individually determined and reflected in the data conversion tables. Thus, the compressed 16 level position tables for each piano reflect individualized, corrected position data compensating for variation in the response and other characteristics of the respective piano. Furthermore, in the case of the half pedal region for the loud pedal, where position errors during play-back would be most noticeable and detrimental, the half pedal region is more finely divided, and therefore receives a greater measure of the allotted 16 position data levels $X_i$.

In the following, the third type of data conversion table will be described. In the case of the present data conversion table, the data conversions carried out are the converse of those graphically indicated in FIGS. 9 and 10. Accordingly, this type of data conversion table is referred to as an reverse normalization data conversion table. That is to say, the normalized data values $X_i$ are converted to those values $x_i$ which reflect the unique characteristics of the individual target piano. However, the input data for the reverse normalization data conversion tables is divided among 128 levels, and the output data is similarly divided among 128 levels. Accordingly, for the actual conversion process, for the 16 level normalized data $X_i$ read from the recording media, a supplementing process is carried out by which means the data is converted to 128 level normalized data $X_i$ after which it is supplied to the reverse normalization data conversion table.

In the following section, the numerical factors employed in the automatic music regeneration process will be discussed.

For the position data $x_i$ obtained through application of the above described reverse normalization data conversion table, the position data $x_i$ is further converted to PWM signal control codes (referred to as PWMs control codes hereafter) by means of the above described position - PWM signal conversion table. If the PWM signals obtained according to the value of the above mentioned PWMs control codes are then supplied to solenoids 20*a* and 20*b*, a pedal driving process can be carried out which is compensated for the individual mechanical and structural characteristics of the piano on which it is performed, even if the play-back data was recorded on a different piano. As the pedals are driven through the action of the PWM signals, sensors 35*a* and 35*b* simultaneously detect and output position data, on the basis of which, feedback control of the plungers 20*ap* and 20*bp* is carried out, by which means a certain degree of improvement in the movement accuracy can be achieved.

As mentioned above, feedback control of the plungers 20*ap* and 20*bp* permits a certain degree of improvement accuracy. However, when pedal motion is occurring at a high velocity, the feedback loop is unable to keep up with pedal motion, for which reason pedal position control becomes disordered. It has been considered to increase the gain of the feedback loop in order to remedy this problem, but due to the fact that in the present preferred embodiment, feedback control of the plungers 20*ap* and 20*bp* is unidirectional, if the gain is increased, oscillation of the mechanism is likely to occur. That is to say, the amount of outward thrusting of the plungers 20*ap* and 20*bp* can be controlled by the PWM signals but due to gravitational forces and the like, if the gain is increased, over-shoot is likely to result during the return phase. This cycle then occurs repetitiously with oscillation resulting.

Because of the problem described above, in the present preferred embodiment, the position signals $x_i$ output from the reverse normalization data conversion table are differentiated with respect to time, by which means velocity data $x_i'$ are produced. The velocity data $x_i'$ are then multiplied by a coefficient K1 to generate PWM1 correction control codes, after which the multiplication results are added to the PWMs control codes, and the resulting PWM control signals are supplied to solenoids 20*a* and 20*b*. As thus described, the velocity data $x_i'$ are employed for "feed-forward" control, and the coefficient K1 is, in the case of "feed-forward" control, a control coefficient. Thus, the velocity data $x_i'$ are multiplied by a fixed value K1 to obtain correction factors which are added to the PWMs control code position data, whereby the corrected PWM control signals are supplied to solenoids 20*a* and 20*b*.

Because velocity correction is carried out as described above, even when the pedals are moving at a high velocity, it is possible for the pedal control to closely follow the movement of the pedals. However, for example at the onset of depression of the loud pedal 21*a* or the shift pedal 21*b*, even though the initial velocity is 0, driving force is being applied to the respective pedal mechanism at that time. Similarly, when the pedal first begins to move the change in velocity, i.e. acceleration is marked. Thus, at the initiation of pedal depression, there is a need to carry out pedal position control for the sudden increase in velocity. However, because the initial velocity is 0, correction cannot be carried out on the basis of velocity data, and accordingly, the control mechanism cannot follow the rapid change in motion. This condition is not limited only to the onset of pedal depression, but also occurs whenever acceleration of the pedal mechanism is marked.

Because of the problem described above, in the present preferred embodiment, the position signals $x_i$ output from the reverse normalization data conversion table are differentiated with respect to time two times, by which means acceleration data $x_i''$ are produced. The acceleration data $x_i''$ are then multiplied by a coefficient K2 to generate PWM2 correction control codes, after which the multiplication results are added to the above described addition result (PWMs+PWM1), the results of which are supplied to solenoids 20*a* and 20*b*. As thus described, the acceleration data $x_i''$ are employed for "feed-forward" control. This coefficient K2 may be determined based on the acceleration data $x_i''$ obtained when, for example, increasing PWM signals are applied to the solenoids 20*a*, 20*b* so as to create a fixed acceleration of the respective pedal mechanism, or when a PWM signal of fixed intensity is momentarily applied.

For feedback control, the signals output from sensors 35*a*, 35*b* are compared with position data $x_i$ and the deviation is determined. The deviation values thus determined are then multiplied by a coefficient K3 to generate PWM3 correction control codes, after which the multiplication results are added to the above described addition result (PWMs+PWM1+PWM2) to provide corrected control values. The above mentioned coefficient corresponds to the gain of the feedback loop. The value of K3 is experimentally determined so as to provide a value which eliminates oscillation of the pedal mechanism and provides for stability.

Based on the above described correction factors, the final control code PWM is given as shown below:

$$\begin{aligned} PWM &= PWMs + PWM1 + PWM2 + PWM3 \\ &= PWMs + K1 \cdot x_i' + K2 \cdot x_i'' + K3 \cdot \Delta x \end{aligned} \quad \text{(Equ. 1)}$$

($\Delta x$ indicates the above mentioned deviation)

Figures 11A, 11B:
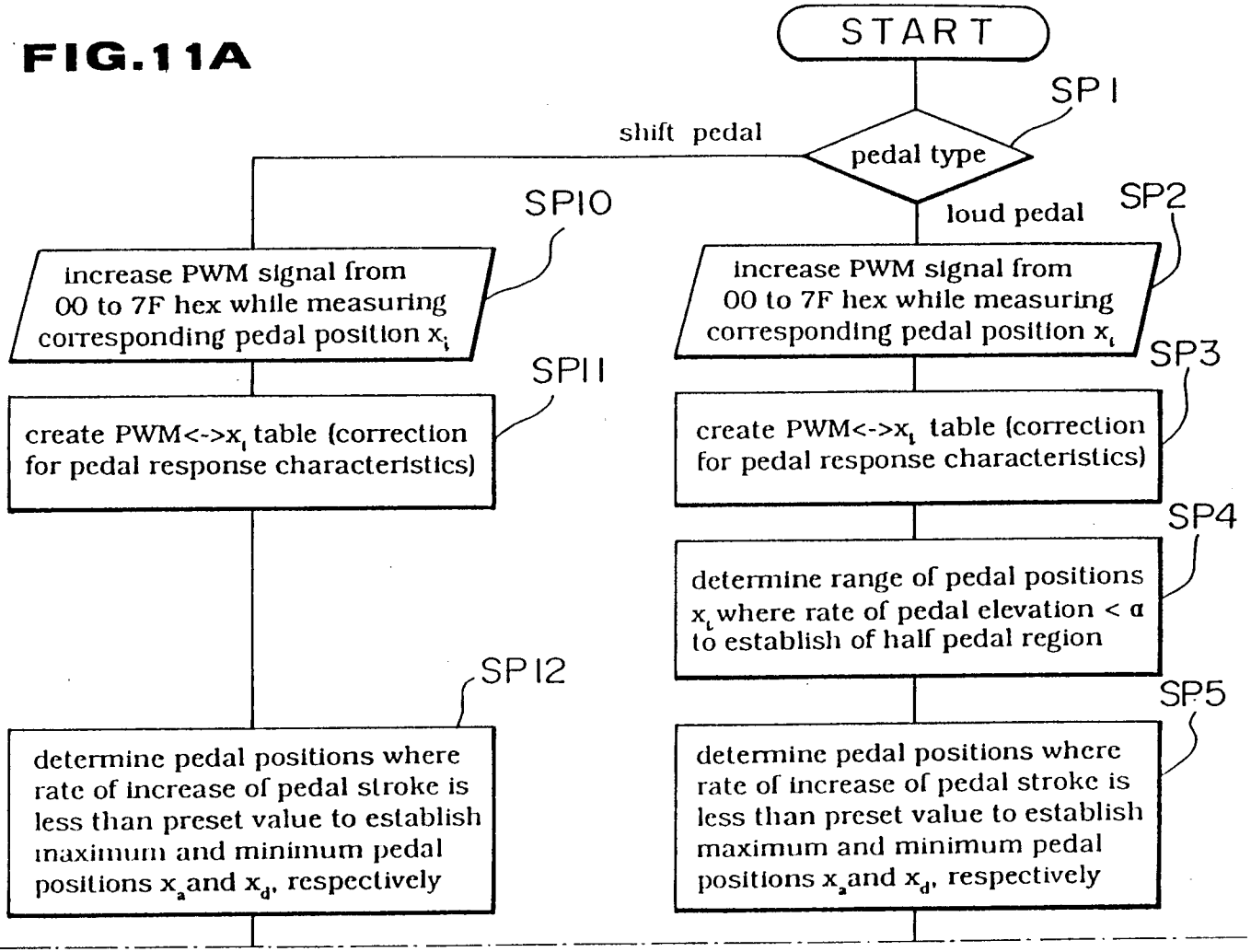
FIGS. 11*a* and 11*b* are a flow chart showing the various operations of the measurement process for the automatic music playing piano of the first preferred embodiment of the present invention.
Figure 11B:
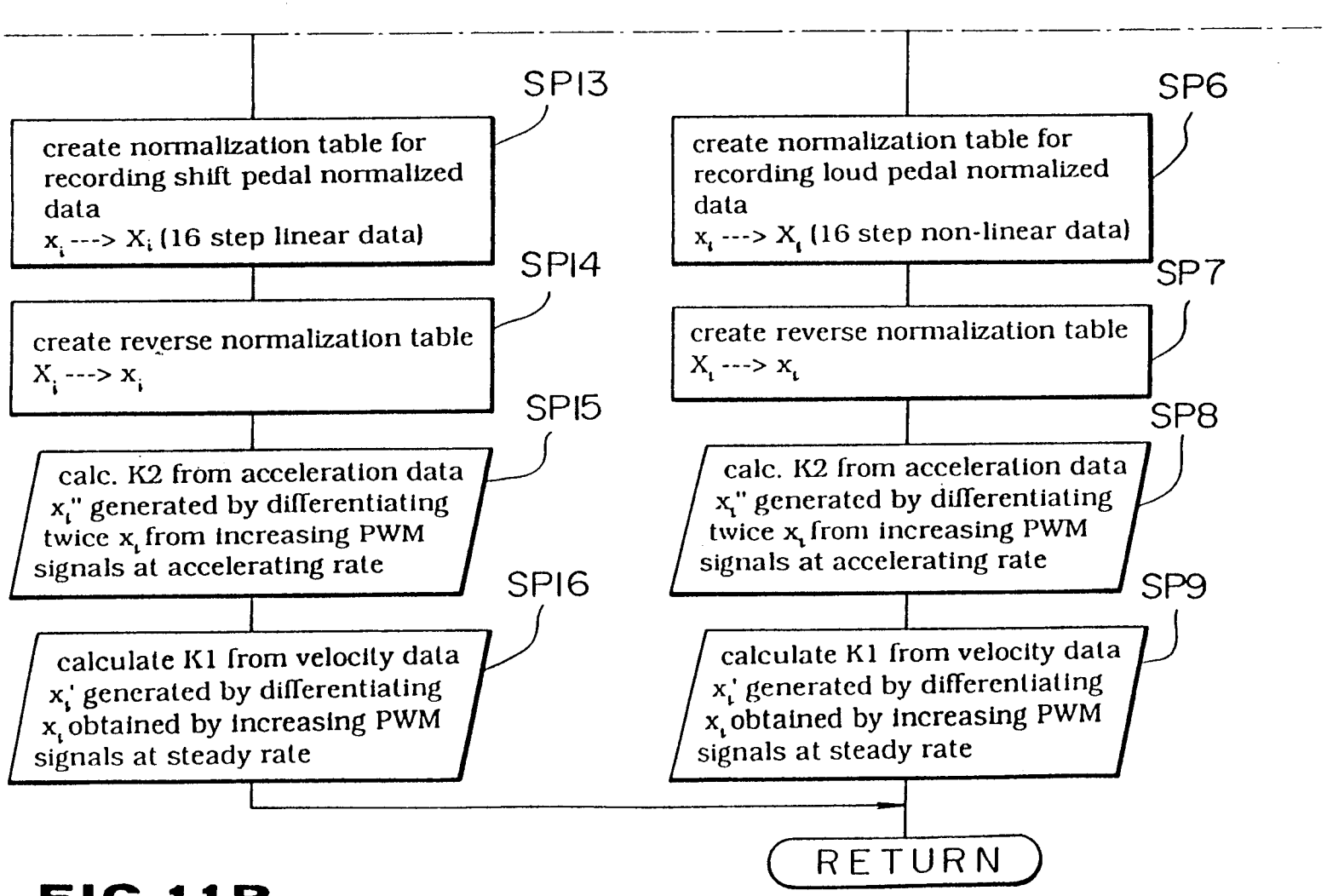

In the following section, the actual position data measurement, creation of data conversion tables, and determination of the coefficients will be described. The operations to be described are carried out as shown in the flow chart in FIGS. 11*a* and 11*b*.

First of all, in step SP1 the type of pedal is judged. That is to say, judgment is made as to whether the measurement operations will be carried out on the loud pedal 21*a* or the shift pedal 21*b*. Which pedal is to be the subject of the measurement operations can be chosen by human operator, or on the basis of a previously decided program.

When [loud pedal] is decided in step SP1, the following step is SP2. In step SP2, the control code is successively increased from 00 to 7F. Through this effect, the PWM control unit included within I/O unit 6*b* outputs PWM signals corresponding to the control codes to the solenoid 20*a*, thereby causing the plunger 20*ap* to rise, the movement of which is detected by sensor 35*a* and output as position signals. The position signals output by sensor 35*a* are converted to digital position signals x by the A/D converter in control unit 6*b*. The digital signals thereby produced are then supplied to CPU 9 as position data $x_i$. Next, in step SP3, the CPU 9 creates a position - PWM conversion table based on the relation of the control code values and the position data $x_i$. The position - PWM conversion table thereby created is stored in RAM 11 and the process then proceeds to step SP4. In step SP4, judgment is made as to whether the rate of elevation of the position data (pedal stroke) $x_i$ is less than a predetermined value a or not. For those position data values $x_i$ corresponding to when this judgment becomes [YES], the half pedal region (in FIG. 9, $x_b$ - $x_c$) is established.

Next, in step SP5, based on when the rate of change of the position data values $x_i$ becomes less than a fixed value, the points when the pedal is released $x_a$ and at maximum displacement of the pedal $x_d$ (refer to FIG. 9) are determined and the process proceeds to step SP6. In step SP6, the normalization data conversion table according to the conversion operation shown in FIG. 9 is created. Then in step SP7, by the same kind of process, the reverse normalization data conversion table is created.

Next, in step SP8, PWM signals increasing at an accelerating rate are applied to solenoid 20*a*, or a fixed PWM signal is momentarily applied to the solenoid 20*a*, and the position data $x_i$ thereby obtained are twice differentiated to create acceleration data $x_i'''$. From these acceleration data $x_i''$ values, the coefficient K2 is determined. Next, in step SP9, a PWM signal increasing at a fixed rate is supplied to the solenoid 20*a*, and the position data $x_i$ thereby obtained are differentiated to create velocity data $x_i'$. From these velocity data $x_i'$ values, the coefficient K1 is determined. After completion of the above described processes, the procedure returns to the main routine (not shown in the diagram).

In step SP1 above, when [shift pedal] is decided, the processes in steps SP10 to SP16 are carried out. These processes are similar to steps SP2 - SP9 above. However, with the shift pedal 21*b*, because the half pedal region determination is not carried out, there is no step corresponding to step SP4.

Figure 12:
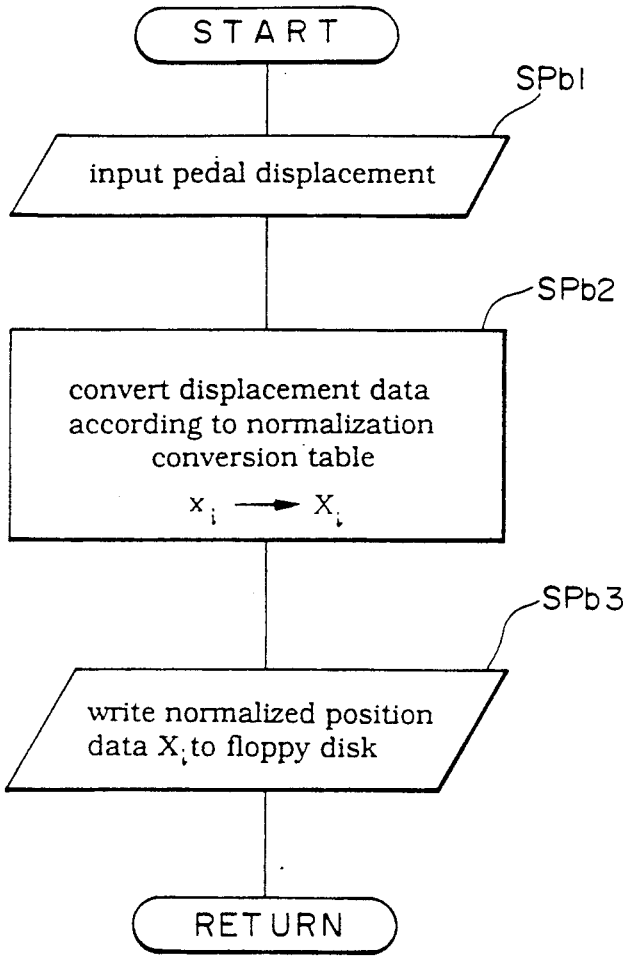
FIG. 12 is a flow chart showing the various operations of the recording process for the automatic music playing piano of the first preferred embodiment of the present invention.
Figure 13:
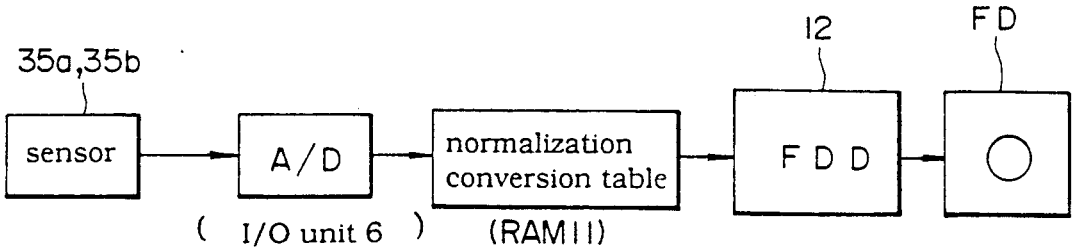
FIG. 13 is a recording process control block diagram for the first preferred embodiment of the present invention.

In the following section, the operation of recording performance data will be explained. A flow chart for the recording operation to be described is shown in FIG. 12. In FIG. 13, a recording control block diagram is shown.

In step SPb1 shown in FIG. 12, the input process for the position data $x_i$ is shown. In this process, in response to the musical performance of the human performer, sensors 35*ba* and 35*b* output position data to I/O unit 6*b*, and the position data is converted to digital position data x by the A/D converter. Next, in step SPb2, according to the normalization data conversion table stored in RAM 11, the data is normalized for the regions (slack, half pedal, damper off), and additionally, the data is compressed to the normalized 16 level position data $x_i$ previously described. The process then proceeds to step SPb3 in which the normalized data is supplied to FDD 12 and there magnetically recorded on a floppy disk.

As described above, by utilizing the normalization data conversion table, the recording of performance data is carried out so that the recorded data is normalized for the unique characteristics of the piano on which the music is originally performed.

Figure 14:
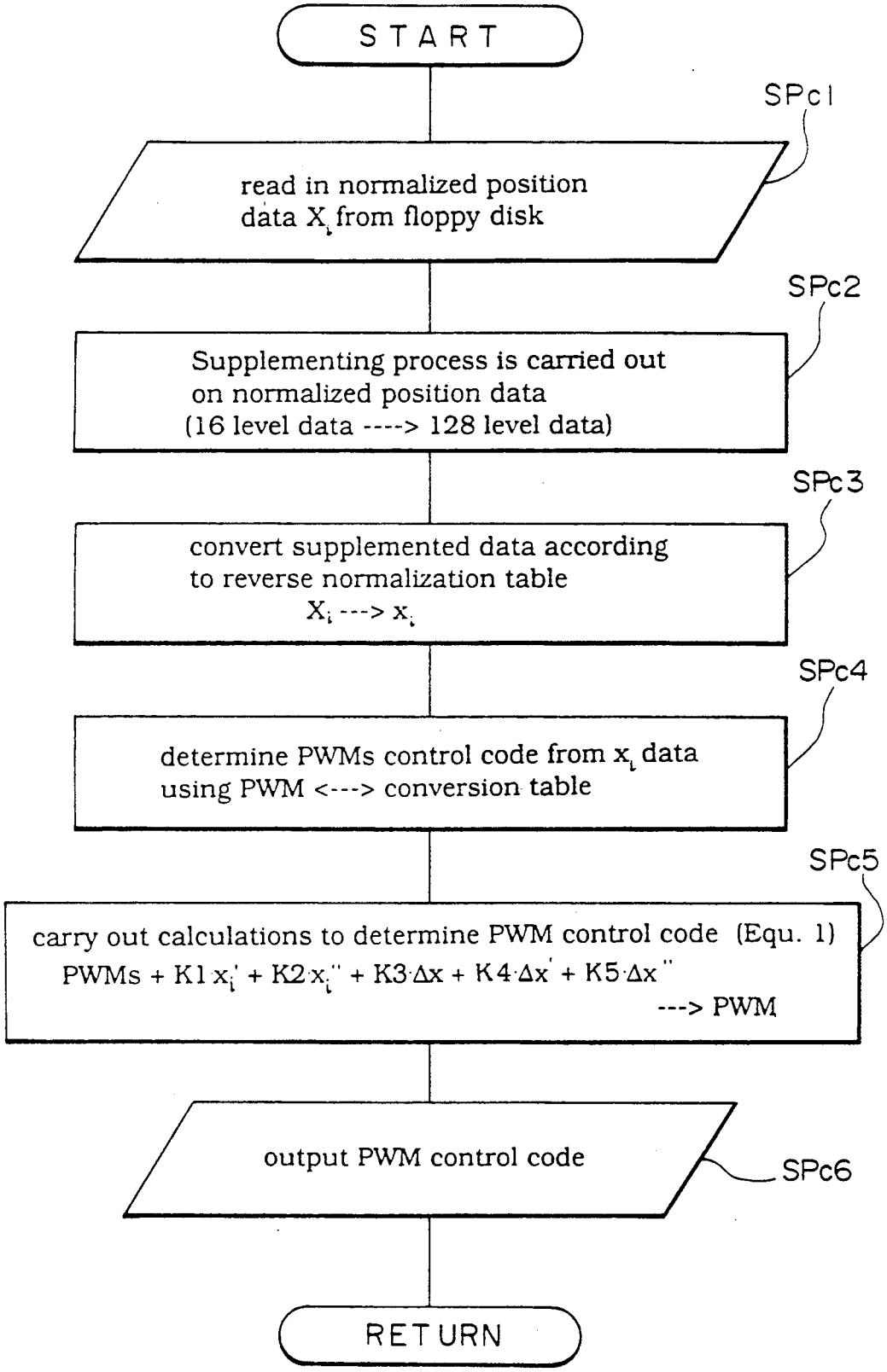
FIG. 14 is a flow chart showing the various operations of the playback process for the first preferred embodiment of the present invention.
Figure 15:
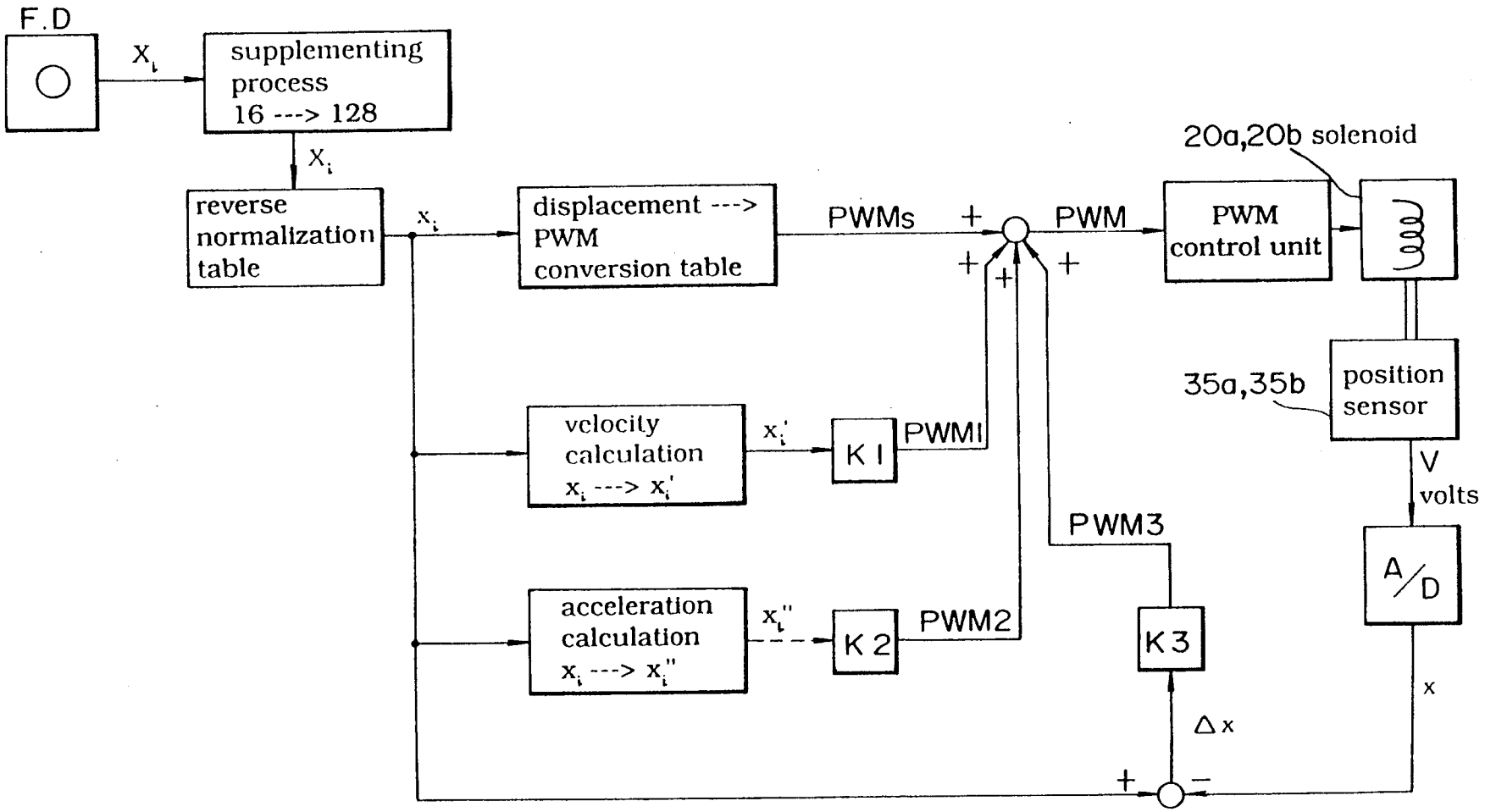
FIG. 15 is a playback process control block diagram for the first preferred embodiment of the present invention.

In the following section, the operation of music play-back will be explained. A flow chart for the play-back operation to be described is shown in FIG. 14. In FIG. 15, a play-back control block diagram is shown.

First of all, in step SPc1, the previously recorded normalized position data $x_i$ is read out from the floppy disk in FDD 12 and supplied to CPU 9 via I/O unit 6*b*. Then, in step SPc2, the supplementing process is carried out in which the 16 level normalized data $X_i$ is converted to 128 level normalized data $X_i$ after which it is supplied to the reverse normalization data conversion table. In the following step SPc3, using the reverse normalization data conversion table previously stored in RAM 11, normalized position data $x_i$ conforming to the unique characteristics of the piano on which the music is replayed is produced. Furthermore, in the following SPc4, using the position - PWM conversion table previously stored in RAM 11, the position data $x_i$ is converted to PWM codes.

Next, the process in step SPc5 is carried out. In this step, the CPU 9 differentiates the position data $x_i$ thereby forming velocity data $x_i'$, and this velocity data $x_i'$ is then multiplied by coefficient K1, thereby forming control codes PWM1. The position data $x_i$ is also twice differentiated, thereby forming acceleration data $x_i''$, and this acceleration data $x_i''$ is then multiplied by coefficient K2, thereby forming control codes PWM2. Furthermore, as shown in FIG. 15, the position signals from the sensors 35*a*, 35*b* are converted to digital position signals x via the A/D converter in I/O unit 6*b*, and these values are then compared with the position signals $x_i$ output from the reverse normalization data conversion table to obtain deviation Δ values. These deviation Δ values are then multiplied by the coefficient K3 to obtain control codes PWM3. Afterwards, again as shown in FIG. 15, the performance calculations are carried out based on the control codes PWMs, PWM1, PWM2, and PWM3 (equation 1 above), thereby determining the control code PWM values.

Next, in step SPc6, the control codes PWM produced in the above described step SPc5 are supplied to the PWM control unit as shown in FIG. 15. The PWM control unit is a circuit provided in I/O unit 6*b* where driving current corresponding to the supplied control codes PWM is generated and then sent to the solenoids 20*a*, 20*b*. After the completion of step SPc6, the process returns to the main routine.

Based on the above described process, correction for the response and other mechanical characteristics of the pedal mechanisms can be carried out. Thus, through pedal velocity correction, pedal acceleration correction, as well as feed-back signal correction, the nuances of the originally performed music are reproduced upon replay, even when carried out on a different piano.

With the present preferred embodiment as described above, by employing the normalization table during the recording of a performance, normalized data $x_i$ is generated, that is, the actual position data x is normalized in terms of the individual response characteristics unique to the piano on which the music is performed. When the music is replayed, by employing the reverse normalization table, the recorded normalized position data $X_i$ is converted to position data $x_i$ which reflects the response characteristics of the piano on which it is being replayed. Thus, regardless of the piano on which the music is recorded and regardless of the piano on which the music is replayed, when the performance is played again, the performance data is adjusted in take into the response characteristics of the piano on which it is being played. Accordingly, the nuances of the pedal action of the original performance are preserved.

Further, by virtue of the data compression carried out on the position data $x_i$, the recorded pedal movement data does not require an excessively large area of the recording media, and thus, performances of a long duration may be recorded. Through the use of the normalization and reverse normalization tables, even though the data is compressed, there is no sacrifice in the ability to reproduce the nuances of the original performance.

Furthermore, the present invention performs not only normalization in terms of each piano's static (response) characteristics, but also performs normalization in terms of the movement characteristics of each piano's pedal mechanisms through normalizing for velocity and acceleration. Through feedback control of the above mentioned normalization for velocity and acceleration, exceedingly accurate reproduction of pedal movements are possible, even at high pedal velocities.

Furthermore, due to the fact that plungers 20*ap* and 20*bp* of solenoids 20*a* and 20*b* connect directly with rods 22*a* and 22*b* below which are in turn connected with loud pedal 21*a* and shift pedal 21*b* respectively, and due to the fact that plungers 20*ap* and 20*bp* connect directly with rods 23*a* and 23*b* above, extraneous noise from the pedal mechanism during performance or replay is minimized.

In the following section, a second preferred embodiment of the present invention will e described with reference to FIG. 16. The automatic playing piano of the present embodiment is based on the automatic playing piano of the first preferred embodiment with further improvements included.

As is the case with the automatic music playing piano of the first preferred embodiment shown in FIG. 15, by means of PWM1 and PWM2 control codes, feed forward control of the velocity and acceleration of the respective pedals is carried out in the present embodiment. With such a piano, however, when a differential develops between the position data $x_i$ and and the position data x detected by sensor 35*a* or 35*b*, position feedback control employing the above described PWM3 is insufficient to provide suitably rapid control of pedal response. If the gain of the PWM3 feedback loop is increased, a more rapid response can be achieved, but then oscillation in the pedal mechanism is likely to arise, as previously discussed. For these reasons, with the automatic playing piano of the present embodiment as shown in FIG. 16, feedback control of pedal velocity and acceleration is also carried out. Thus when compared to the piano of the first preferred embodiment, the piano of the present embodiment provides more accurate high speed pedal control, and accordingly, provides for a more faithful reproduction of the pedal movements recorded during the original performance.

Figure 16:
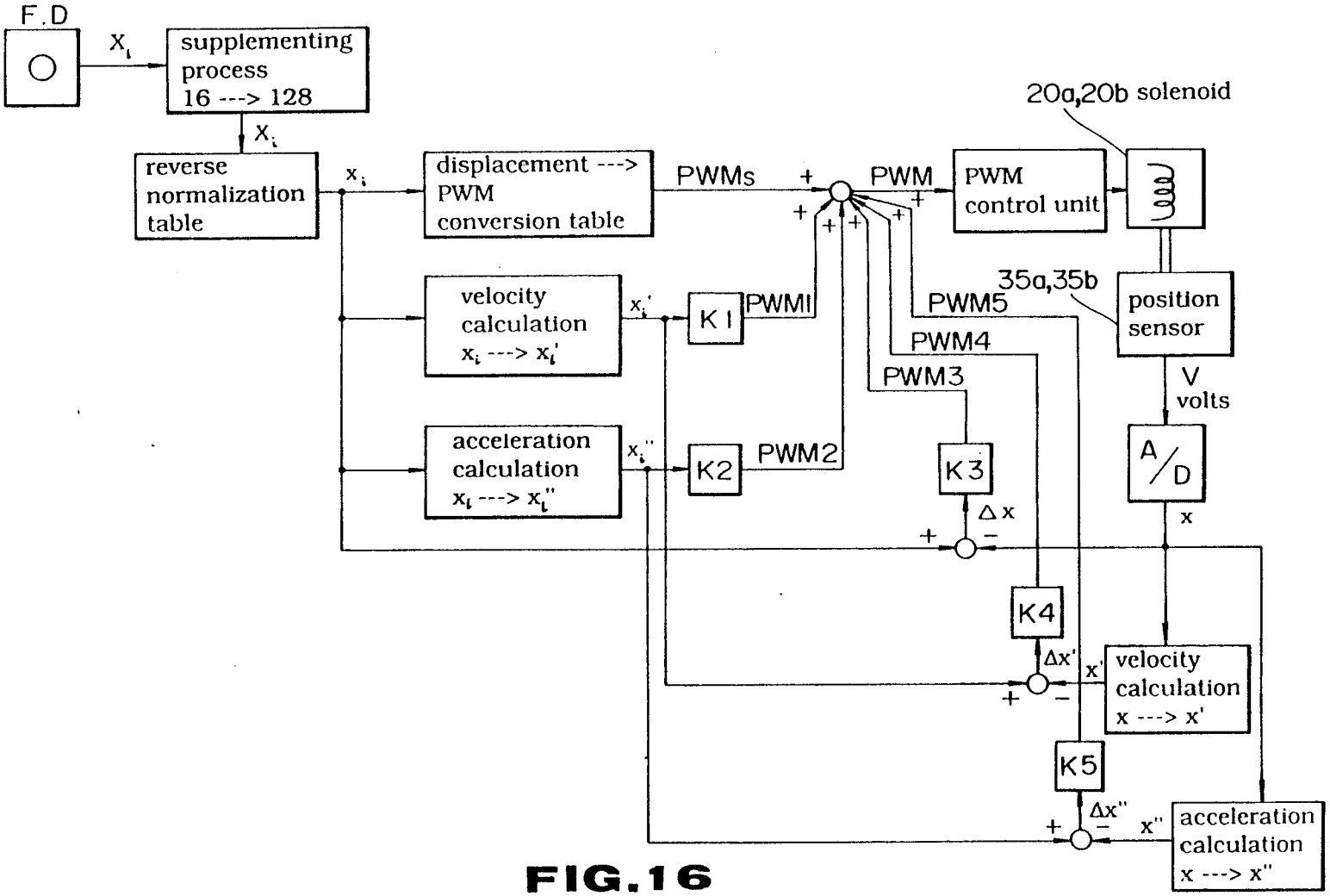
FIG. 16 is a playback process control block diagram for the second preferred embodiment of the present invention.

As shown in FIG. 16, the differential of position data x with respect to time is determined, thereby generating velocity data x' (velocity feedback data). Similarly, the differential of velocity data x' with respect to time is determined, thereby generating acceleration data x'' (acceleration feedback data). Then, the deviation between velocity data $x_i'$ and velocity data x' is determined to generate $\Delta x'$, which is then multiplied by coefficient K4 to provide control code PWM4. Similarly, the deviation between acceleration data $x_i'$ ad acceleration data x'' is determined to generate $\Delta x''$, which is then multiplied by coefficient K5 to provide control code PWM5. Finally, the control codes PWM4 and PWM5 thereby are added to the sum of control codes PWMs, PWM1, PWM2 and PWM3 as shown below in Equ. 2, the result of which is supplied to control unit 6a.

$$\begin{aligned} PWM &= PWMs + PWM1 + PWM2 + PWM3 + PWM4 + PWM5 \\ &= PWMs + K1 \cdot x_i' + K2 \cdot x_i'' + K3 \cdot \Delta x + K4 \cdot \Delta x' + K5 \cdot \Delta x'' \end{aligned} \quad \text{(Equ. 2)}$$

The values for K4 and K5 used in Equ. 2 above, are experimentally determines values, chosen so as to avoid oscillation of the pedal mechanisms and to provide stable operation.

It is not necessary that coefficients K1–K5 be fixed values. For example, a different set of the coefficients could be used for each of the slack region, the half pedal region, and the damper off region. Similarly, different values could be use at the onset of pedal motion $x_a$, and in the vicinity of termination of pedal motion $x_d$ (refer to FIG. 9). Also, it is possible to use different values during pedal depression and during pedal elevation. Furthermore, the values of K1–K5 may be sequentially varied in response to the values of $x_i$, $x_i'$ and $x_i''$. When the position is in the vicinity of points $x_a$, $x_b$, $x_c$ or $x_d$ (FIB. 9), because the change in pedal load is great, if the values of K1–K5 are variable in the vicinity of points $x_a$, $x_b$, $x_c$ or $x_d$, then it becomes possible to achieve more accurate control. When it is desirable to simplify the circuitry, the acceleration component of the feedback, feed-forward control can be eliminated from Equ. 2 above, thus giving Equ. 3 below.

$$\begin{aligned} PWM &= PWMs + PWM1 + PWM3 + PWM4 \\ &= PWMs + K1 \cdot x_i' + K3 \cdot \Delta x + K4 \cdot \Delta x' \end{aligned} \quad \text{(Equ. 3)}$$

The different ways to vary the values of K1–K5 as described above for the loud pedal are also applicable to the shift pedal. Similarly, the above described pedal mechanism features may be applied to an upright piano, as well as a grand piano.

What is claimed is:

1. A pedal movement control and recording apparatus for an automatic music playing piano comprising:

at least one pedal for musical tone control, said pedal having a range of displacement;

a pedal drive means for driving said pedal;

a pedal displacement detection means for determining the displacement of said pedal;

a conversion table creation means for creating a conversion table, in which said conversion table creation means sequentially changes characteristics for a drive signal supplied to said pedal drive means while detecting pedal displacement with said pedal displacement detection means, wherein a position data conversion table is created based on a relationship between the characteristics of said drive signal supplied to said pedal drive means and said pedal displacement detected by said pedal displacement detection means, said conversion table creation means including means for determining a half pedal region in the range of displacement of the pedal corresponding to a change in pedal displacement characteristics; and control means for receiving recorded performance data for said automatic music playing piano and driving the pedal drive means in response to the performance data and in accordance with the conversion table and said half pedal region.

2. A pedal movement control and recording apparatus in accordance with claim 1 above further comprising a normalization table for use during a recording of a performance, wherein a signal output from said pedal displacement detection means during recording which reflects individual characteristics of the automatic music playing piano on which the performance is recorded, is converted to normalized data by means of the normalization table.

3. A pedal movement control and recording apparatus for an automatic music playing piano in accordance with claim 2 above in which the normalized data and the signal output from said pedal displacement detection means each comprises a number of data bits and the number of bits in the normalized data is less than the number of bits in the signal output from said pedal displacement detection means.

4. A pedal movement control and recording apparatus in accordance with claim 1 above further comprising a memory means for storing performance data and a drive signal supply means for supplying a drive signal to said pedal drive means, whereby during an automatic performance, performance data is read out from said memory means and converted to pedal drive data by means of said position data conversion table, thereby forming a pedal drive signal which is supplied to said pedal drive means.

5. A pedal movement control and recording apparatus in accordance with claim 4 above further comprising a normalization table for use during a recording of a performance, wherein a signal output from said pedal displacement detection means which reflects individual characteristics of the automatic music playing piano on which the performance is recorded, is converted to normalized data by means of the normalization table, further comprising a data writing means for writing data to said memory means, whereby said normalized data converted by said normalization table is written to said memory means.

6. A pedal movement control and recording apparatus for an automatic music playing piano in accordance with claim 5 above in which the normalized data and the signal output from said pedal displacement detection means each comprises a number of data bits and the number of bits in said normalized data is less than the number of bits in the signal output from said pedal displacement detection means.

7. A pedal movement control and recording apparatus for an automatic music playing piano in accordance with claim 5 above further comprising a reverse normalization table by which means data read from said memory means is converted to data which indicates pedal displacement, and also comprising a means to supply data converted by said reverse normalization table to said position data conversion table.

8. A pedal movement control and recording apparatus in accordance with claim 4 in which said pedal drive data is differentiated with respect to time to provide a result, and the result of said differentiation and said pedal drive data are each multiplied by a coefficient to provide results, and in which the results of said multiplications by said coefficients are summed, whereby said pedal drive signal is generated.

9. A pedal movement control and recording apparatus in accordance with claim 4 in which said pedal drive data is differentiated with respect to time to provide first results and is twice differentiated with respect to time to provide second results, and the first and second results and said pedal drive data are each multiplied by a coefficient to provide results, and in which the results of said multiplications by said coefficients are summed, whereby said pedal drive signal is generated.

10. A pedal movement control and recording apparatus in accordance with claim 4 in which said pedal drive data is differentiated with respect to time to provide first results and is twice differentiated with respect to time to provide second results, said pedal drive data and the signal output from said pedal displacement means are compared to provide deviation results, said pedal drive data, the first and second results and the deviation results are each multiplied by a coefficient to provide multiplication results, and the multiplication results are summed, whereby said pedal drive signal is generated.

11. A pedal movement control and recording apparatus in accordance with claim 4 in which said pedal drive data is differentiated with respect to time to provide first differentiation results and is twice differentiated with respect to time to provide second differentiation results, said signal output from said pedal displacement detection means is differentiated with respect to time to provide third differentiation results, said pedal drive data and the signal output from said pedal displacement detection means are compared to provide first deviation results, said first differentiation results and said third differentiation results are compared to provide second deviation results, said pedal drive data, said first differentiation results, said second differentiation results, said first deviation results and said second deviation results are each multiplied by a coefficient to provide multiplication results, and the multiplication results are summed, whereby said pedal drive signal is generated.

12. A pedal movement control and recording apparatus in accordance with claim 4 in which said pedal drive data is differentiated with respect to time to provide first differentiation results and is twice differentiated with respect to time to provide second differentiation results, said signal output from said pedal displacement detection means is differentiated with respect to time to provide third differentiation results and is twice differentiated with respect to time to provide fourth differentiation results, said pedal drive data and the signal output from said pedal displacement detection means are compared to provide first deviation results, said first differentiation results and said third differentiation results are compared to provide second deviation results, said second differentiation results and said fourth differentiation results are compared to provide third deviation results, said pedal drive data, said first differentiation results, said second differentiation results, said first deviation results, said second deviation results and said third deviation results are each multiplied by a coefficient to provide multiplication results, and the multiplication results are summed whereby said pedal drive signal is generated.

13. A pedal movement control and recording apparatus in for an automatic music playing piano comprising at least one pedal for musical tone control, a pedal drive means for driving said pedal, a pedal displacement detection means for determining the displacement of said pedal, and a state judgment means for determining different operating states of said pedal in which pedal displacement characteristics are different in response to the driving of the pedal, wherein said state judgment means sequentially changes characteristics of a drive signal supplied to said pedal drive means while detecting pedal displacement with said pedal displacement detection means, so as to determine the different pedal operating states.

14. A pedal movement control and recording apparatus for an automatic music playing piano in accordance with claim 13 above in which said state judgment means determines a half pedal state for a loud pedal.

15. A pedal movement control and recording apparatus for an automatic music playing piano in accordance with claim 13 above in which said state judgment means determines a slack state for said at least one pedal.

16. A pedal movement control and recording apparatus for an automatic music playing piano comprising:

at least one pedal for musical tone control, a pedal drive means for driving said pedal, a pedal displacement detection means for determining the displacement of said pedal, a conversion table creation means for creating a conversion table, in which said conversion table creation means sequentially changes characteristics for a drive signal supplied to said pedal drive means while detecting pedal displacement between maximum and minimum values with said pedal displacement detection means, wherein a position data conversion table is created based on a relationship between the characteristics of said drive signal supplied to said pedal drive means and said pedal displacement detected by said pedal displacement detection means, and said control means for receiving recorded performance data for said automatic music playing piano including data representing commanded pedal position with reference to normalized minimum and maximum positions and for providing a drive signal to the pedal drive means in accordance with the commanded pedal position and the conversion table.

17. A pedal control apparatus for an automatic music playing piano having at least one pedal for a musical tone control, comprising:

a pedal drive means for driving said pedal;

a pedal displacement detection means for determining the displacement of said pedal;

characteristics determining means for determining drive value versus displacement characteristics for said pedal; and control means for receiving normalized pedal performance data representing desired pedal position between minimum and maximum displacement and converting the normalized data to drive data for said pedal drive means in accordance with the characteristics determined by the characteristics determining means.

18. A pedal control apparatus as in claim 17 wherein:

the characteristics determining means includes means for determining a half pedal range of displacement of the pedal; and the control means receives normalized pedal performance data including data corresponding to desired pedal displacement within the half pedal range and converts the normalized data to drive data for the pedal drive means in accordance with determined drive value versus displacement characteristics and in accordance with the determined half pedal range.

19. A pedal control apparatus as in claim 18 wherein the performance data is compressed data representing a predetermined number of possible normalized pedal displacement values between minimum and maximum displacement, wherein possible displacement values within a normalized half pedal range represent smaller displacement increments than possible displacement values outside the half pedal range, and wherein the control means includes means for converting data within the normalized half pedal range into drive signals for the half pedal range of said pedal, whereby high resolution is obtained in the half pedal range despite the use of compressed data.

20. A piano system for producing recordings for automatic music playing pianos, comprising:

a piano having at least one pedal for musical tone control;

pedal displacement detection means for determining displacement of the pedal;

pedal characteristics determining means for determining pedal displacement values of the detection means which correspond to at least one of a slack range or a half pedal range of the pedal;

recording means for recording a musical performance on the piano including means coupled to the detection means for recording pedal displacement during the musical performance; and converting means for converting the recorded pedal displacement to a normalized recording with reference to the determined slack range or half pedal range so that particular pedal displacement values in the normalized recording positively represent desired slack range or half pedal range operation during reproduction of the normalized recording.

21. A piano system as in claim 20 wherein the converting means includes means for compressing the recorded pedal displacement to correspond to a predetermined plurality of possible normalized values between minimum and maximum pedal displacement.

22. A piano system as in claim 21 wherein the range determined is the half pedal range and wherein the means for compressing provides a greater number of possible normalized values per given amount of pedal displacement within the half pedal range than outside of the half pedal range, thereby providing high resolution in the half pedal range despite compression.

23. A piano system as in claim 22 wherein the piano is an automatic music playing piano, the system further comprising:

pedal drive means for driving the pedal; and control means for reading a normalized recording in which particular pedal displacement values positively represent desired half pedal range operation and converting the normalized recording into pedal drive signals with reference to the determined half pedal range for the pedal so that the pedal is accurately driven in its half pedal range in response to reading of normalized displacement values representing desired half pedal range operation.

24. A piano system as in claim 23 wherein the pedal characteristics determining means determines pedal displacement values corresponding to the half pedal range by causing the drive means to sequentially generate drive signals to drive the pedal, determining a drive signal versus pedal displacement relationship and detecting changes in the drive signal characteristics with displacement.

* * * * *